US009290973B2

(12) United States Patent
Quinn

(10) Patent No.: US 9,290,973 B2
(45) Date of Patent: Mar. 22, 2016

(54) LIVING HINGE

(75) Inventor: H Stephen Quinn, Eau Claire, WI (US)

(73) Assignee: Plastek Industries, Inc., Erie, PA (US)

( * ) Notice: Subject to any disclaimer, the term of this patent is extended or adjusted under 35 U.S.C. 154(b) by 6 days.

(21) Appl. No.: 13/808,102

(22) PCT Filed: Sep. 29, 2011

(86) PCT No.: PCT/US2011/053858

§ 371 (c)(1),
(2), (4) Date: Jan. 3, 2013

(87) PCT Pub. No.: WO2012/050949

PCT Pub. Date: Apr. 19, 2012

(65) Prior Publication Data

US 2014/0008381 A1 Jan. 9, 2014

Related U.S. Application Data

(60) Provisional application No. 61/387,965, filed on Sep. 29, 2010.

(51) Int. Cl.

| | |
|---|---|
| ***B65D 43/16*** | (2006.01) |
| ***E05D 1/02*** | (2006.01) |
| ***B65D 47/08*** | (2006.01) |

(52) U.S. Cl.

CPC ..... *E05D 1/02* (2013.01); *B65D 43/168* (2013.01); *B65D 47/0809* (2013.01); *B65D 2543/00101* (2013.01); *B65D 2543/00351* (2013.01); *B65D 2543/00537* (2013.01)

(58) Field of Classification Search

CPC ..... B65D 43/168; B65D 47/0809; B65D 2543/00537; B65D 2543/00101; B65D 2543/00351; E05D 1/02

USPC ..... 220/254.3, 254.5, 836–839, 4.23; 215/235, 237, 244, 245; 222/556

See application file for complete search history.

(56) References Cited

U.S. PATENT DOCUMENTS

| | | | | |
|---|---|---|---|---|
| 5,381,920 | A * | 1/1995 | Lin | 220/843 |
| 5,499,736 | A * | 3/1996 | Kohl | 220/254.5 |
| 6,439,410 | B1 * | 8/2002 | Dubach | 215/235 |
| 2005/0035118 | A1 * | 2/2005 | Garg et al. | 220/4.23 |

(Continued)

FOREIGN PATENT DOCUMENTS

| | | | |
|---|---|---|---|
| JP | 06-076090 | U | 10/1994 |
| JP | 09-249243 | A | 9/1997 |

(Continued)

OTHER PUBLICATIONS

International Search Report and Written Opinion for PCT/US2011/053858, dated Apr. 17, 2012.

*Primary Examiner* — Fenn Mathew
*Assistant Examiner* — James N Smalley
(74) *Attorney, Agent, or Firm* — Bachman & LaPointe, P.C.

(57) ABSTRACT

A system (20; 302) comprising the unitarily molded single-piece combination of: a first portion (24; 324); a living hinge (22; 322); and a second portion (26; 326) coupled by the living hinge to the first portion and shiftable between a first condition and second condition via rotation about the living hinge. The living hinge comprises: a first end (80) at the first portion; and a second end (82) at the second portion, in the as-molded condition the second end is spaced upward from the first end.

21 Claims, 12 Drawing Sheets

(56) References Cited

U.S. PATENT DOCUMENTS

| | | | | |
|---|---|---|---|---|
| 2006/0011667 | A1* | 1/2006 | Skillin et al. | 222/556 |
| 2007/0138123 | A1* | 6/2007 | Blomdahl et al. | 215/235 |
| 2008/0110933 | A1* | 5/2008 | Goncalves | 222/153.05 |

FOREIGN PATENT DOCUMENTS

| | | | |
|---|---|---|---|
| JP | 10-230954 | A | 9/1998 |
| JP | 3151025 | U | 5/2009 |

* cited by examiner

LIVING HINGE

CROSS-REFERENCE TO RELATED APPLICATION

Benefit is claimed of U.S. patent application Ser. No. 61/387,965, filed Sep. 29, 2010, the disclosure of which is incorporated by reference in its entirety herein as if set forth at length.

BACKGROUND OF THE INVENTION

The invention relates to packaging. More particularly, the invention relates to living hinges for molded package closures.

SUMMARY OF THE INVENTION

One aspect of the invention involves a system comprising the unitarily molded single-piece combination of: a first portion; a living hinge; and a second portion coupled by the living hinge to the first portion and shiftable between a first condition and second condition via rotation about the living hinge. The living hinge comprises: a first end at the first portion; and a second end at the second portion. In the as-molded condition the second end is spaced upward from the first end.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
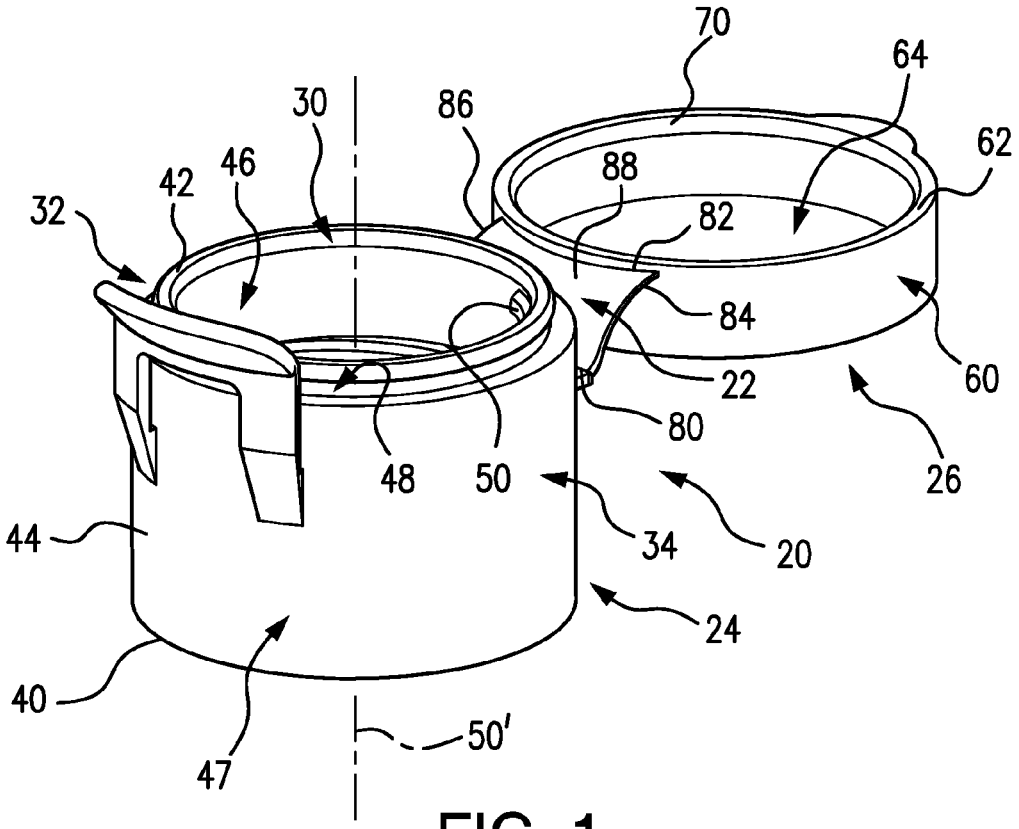
FIG. 1 is an open isometric view of a molded closure in an open as molded condition.
Figure 2:
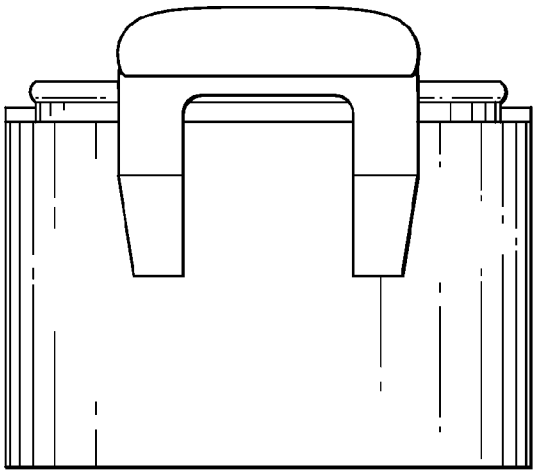
FIG. 2 is a front view of the closure of FIG. 1.

FIG. 1 shows a closure system 20 in an open condition. The illustrated exemplary system 20 comprises a unitarily molded combination comprising a living hinge 22 coupling a first portion 24 to a second portion 26. The exemplary first portion is a fixed portion such as a mounting base. The exemplary mounting base is internally threaded for screw-on engagement to the mouth of a bottle or similar container body. Snap-on mounting, adhesive mounting, solvent-bond mounting, thermal weld mounting are also possible. The base has an aperture 30 through which product (e.g., foodstuffs, cosmetics, and the like) may be delivered in the open condition. The exemplary aperture is a mouth at an upper portion 32 of a rebated sidewall 34 of the mounting base. In an exemplary typical orientation of a bottle closure, a central vertical axis 500 of the exemplary closure is defined as extending through the aperture. The exemplary sidewall extends from a lower end/rim 40 to an upper end/rim 42 and has an exterior surface 44 and an interior surface 46. A lower portion 47 of the sidewall is separated from the upper portion 32 via a shoulder 48. Along the interior surface, the lower portion bears the internal thread 50.

The exemplary second portion 26 is a cap having a sidewall 60 (extending upward from a lower rim 62) and a transverse web 64 across an upper end of the sidewall. In a closed condition, a lower portion of the cap sidewall surrounds an upper portion of the base and seals therewith. The closed condition may be maintained by cooperating detent moieties 70, 72 on the cap and base. Alternative second portions comprise plugs for receipt by the base aperture. FIG. 1 further shows an exemplary latch system formed by a tab on the cap and a catch on the base. Release may be by finger actuation (e.g., depressing) of the catch (optionally, depending upon implementation, a lifting of the tab). A latching may be via a camming action of the tab against the catch until snapping into an opening of the catch.

Figure 3:
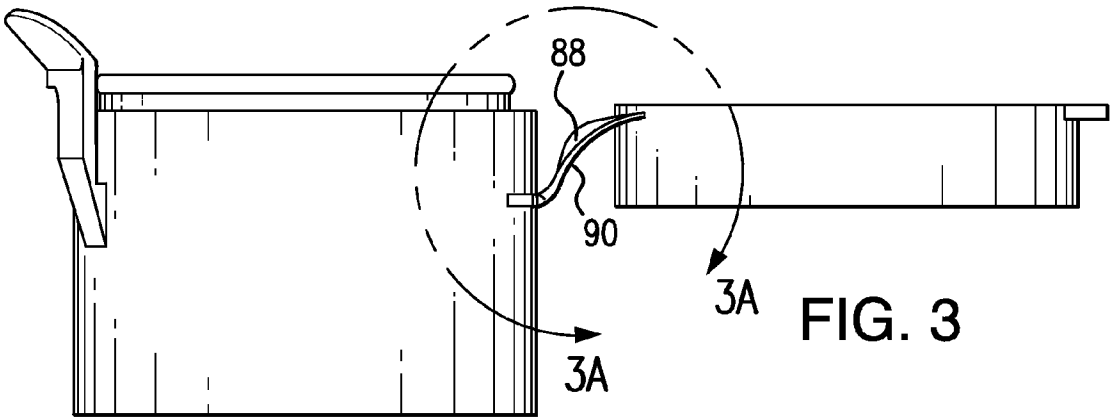
FIG. 3 is a left side view of the closure of FIG. 1, a right side view being a mirror image.
Figure 4:
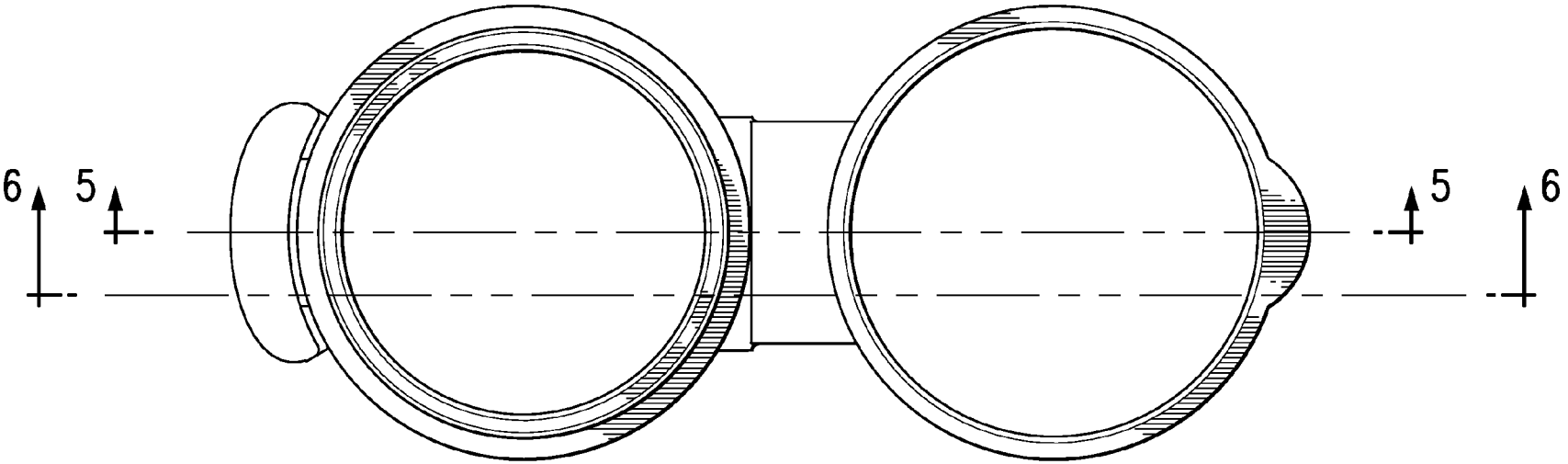
FIG. 4 is a top view of the closure of FIG. 1.
Figure 7:
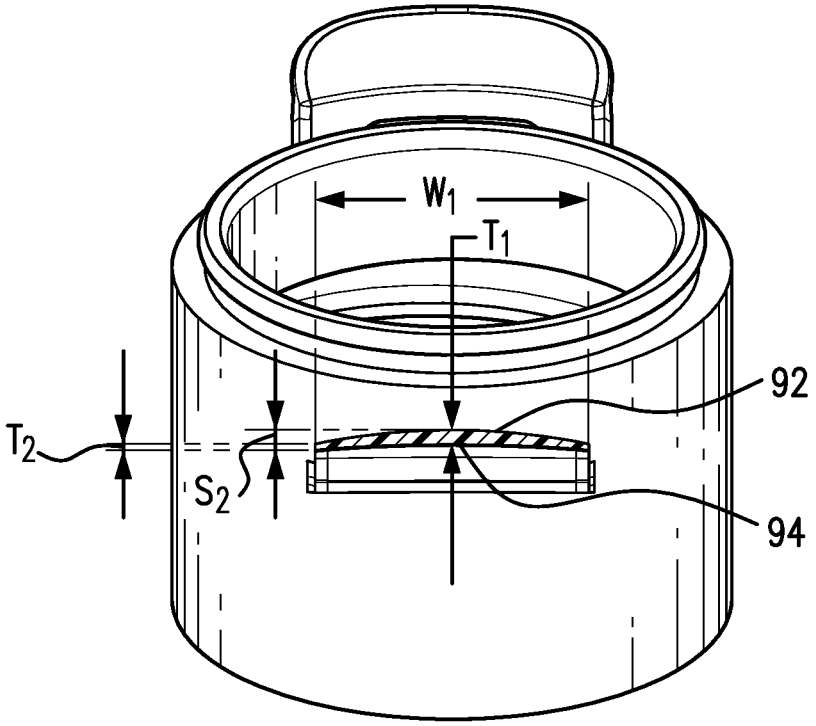
FIG. 7 is a transverse sectional view of the hinge taken along 7-7 of FIG. 6A.
Figure 5:
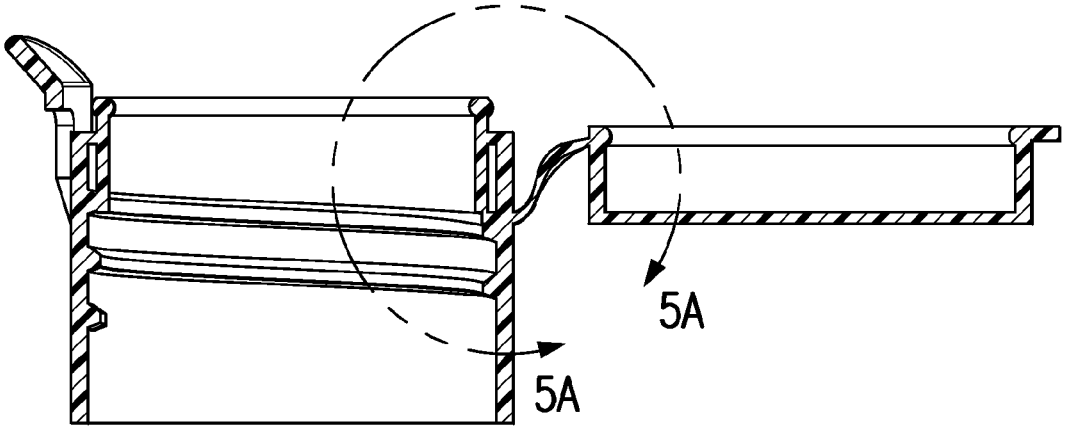
FIG. 5 is a central vertical/longitudinal sectional view of the closure of FIG. 4, taken line 5-5.
Figure 6:
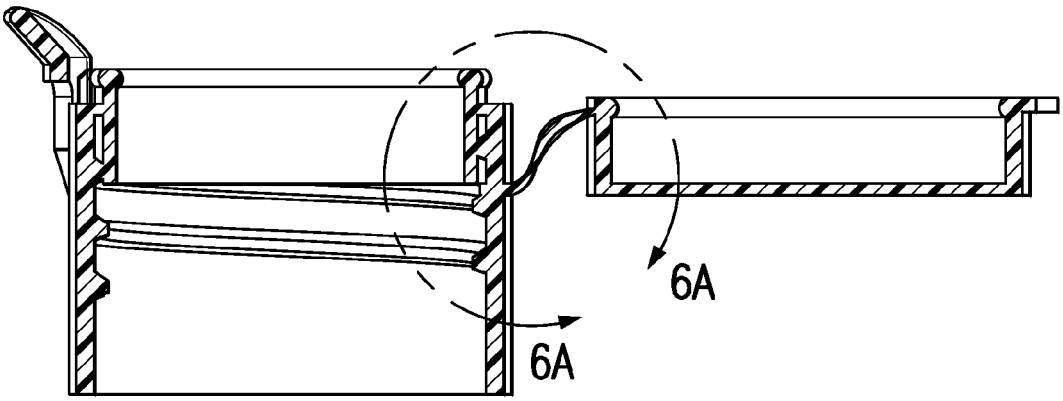
FIG. 6 is an offset vertical/longitudinal sectional view of the closure of FIG. 4, taken along line 6-6.
Figure 5A:
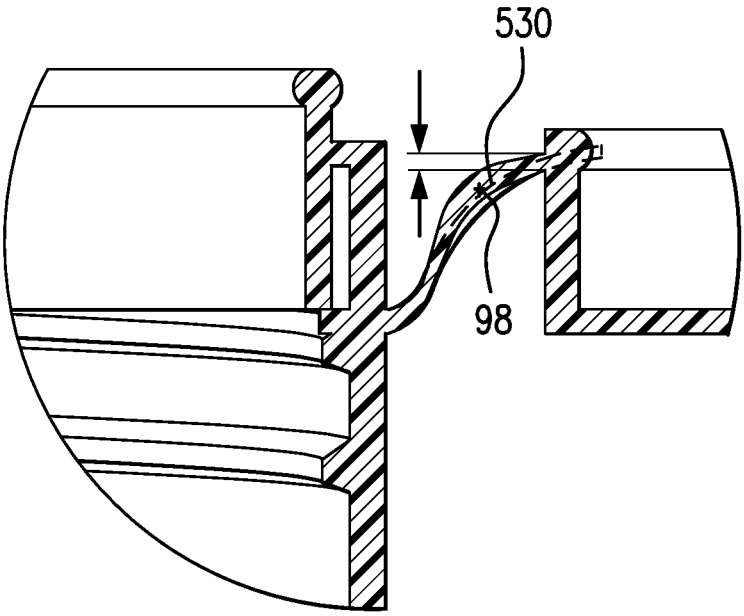
FIG. 5A is an enlarged view of the hinge of FIG. 5.
Figure 6A:
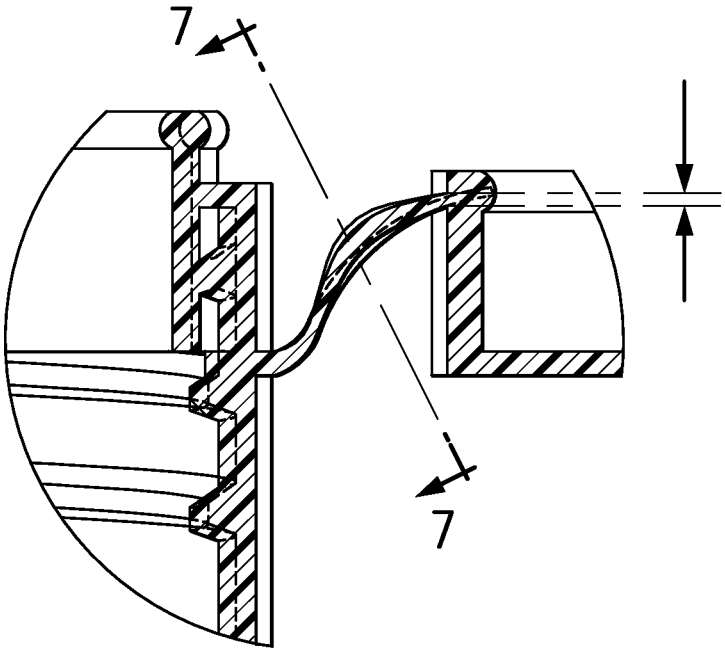
FIG. 6A is a detailed view of the hinge of FIG. 6.
Figure 8:
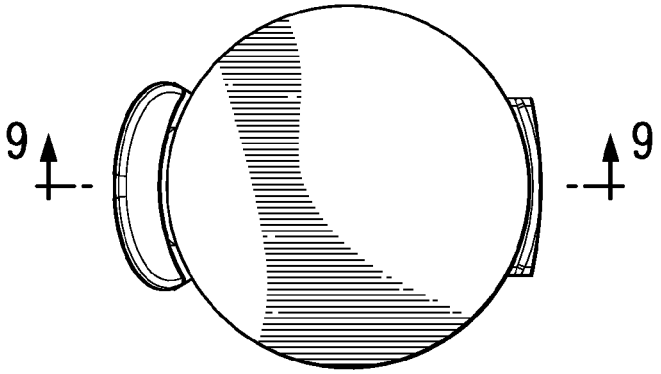
FIG. 8 is a top view of the closure in a snapped closed condition.
Figure 9:
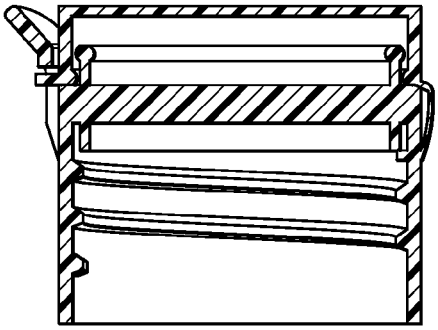
FIG. 9 is a central vertical/longitudinal sectional view of the closure of FIG. 8, taken along line 9-9.
Figure 10:
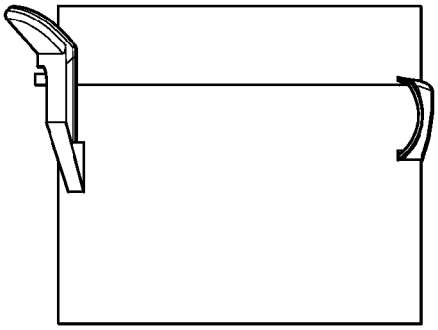
FIG. 10 is a side view of the closure of FIG. 8.
Figure 11:
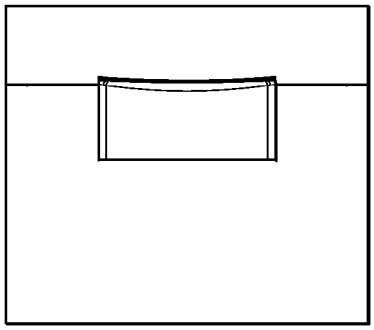
FIG. 11 is a rear view of the closure of FIG. 8.
Figure 12:
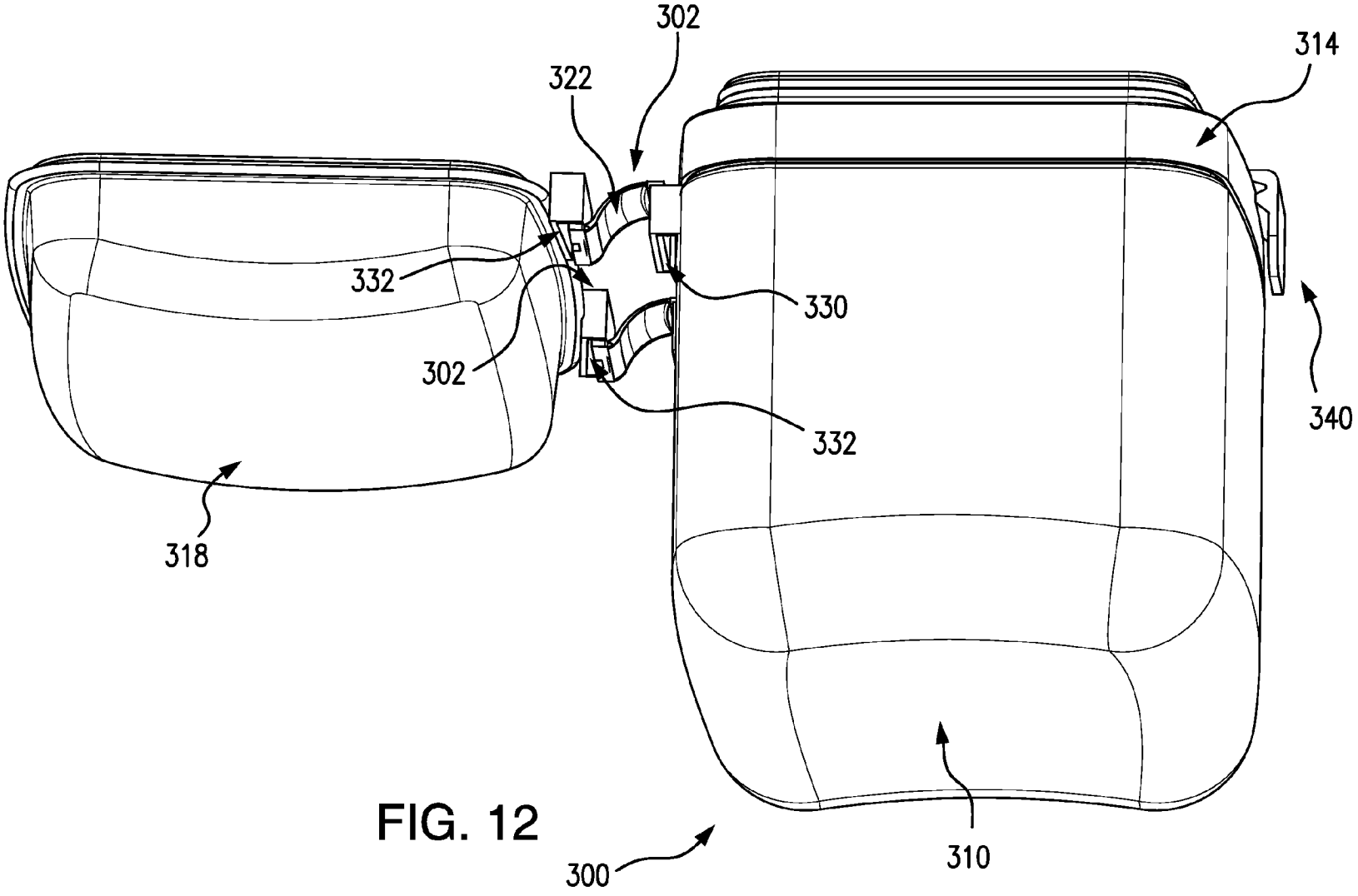
FIG. 12 is a view of a container having a second closure in an open condition.
Figure 13:
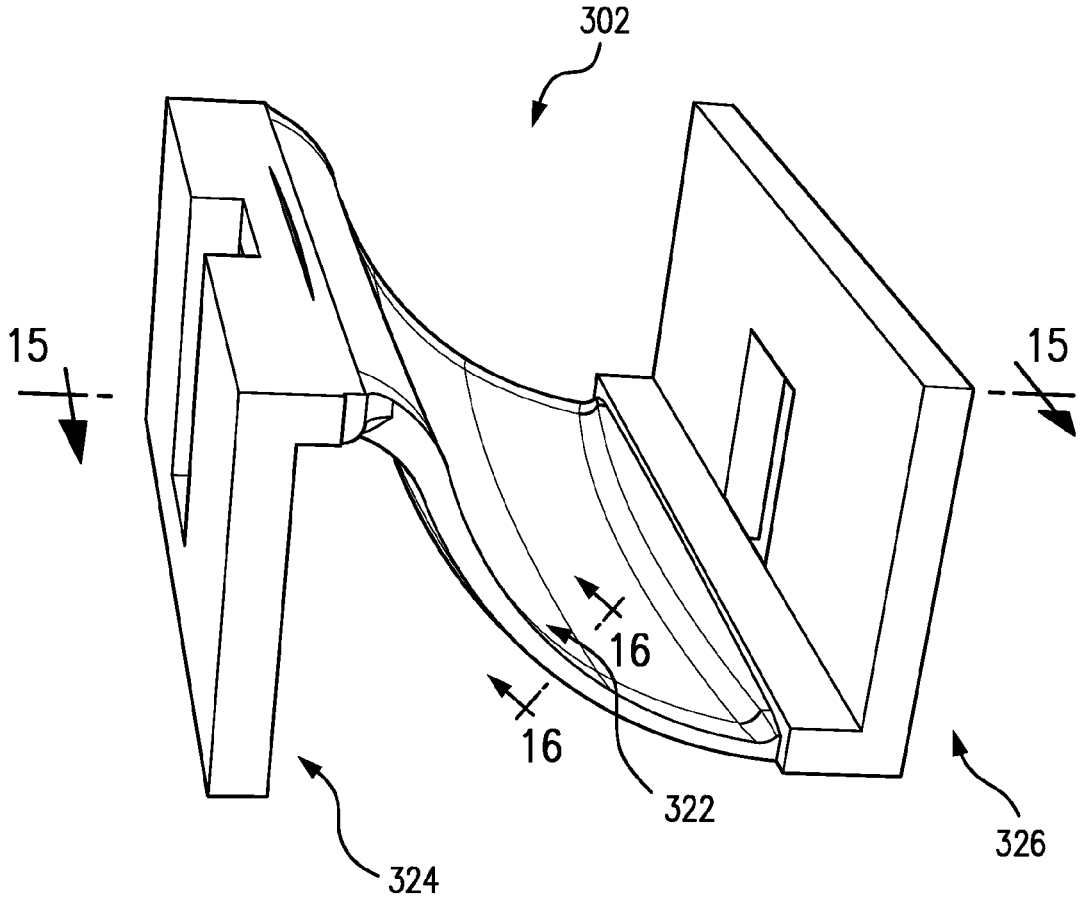
FIG. 13 is a first view of a hinge member of the closure of FIG. 12 in a relaxed/as-molded condition.
Figure 14:
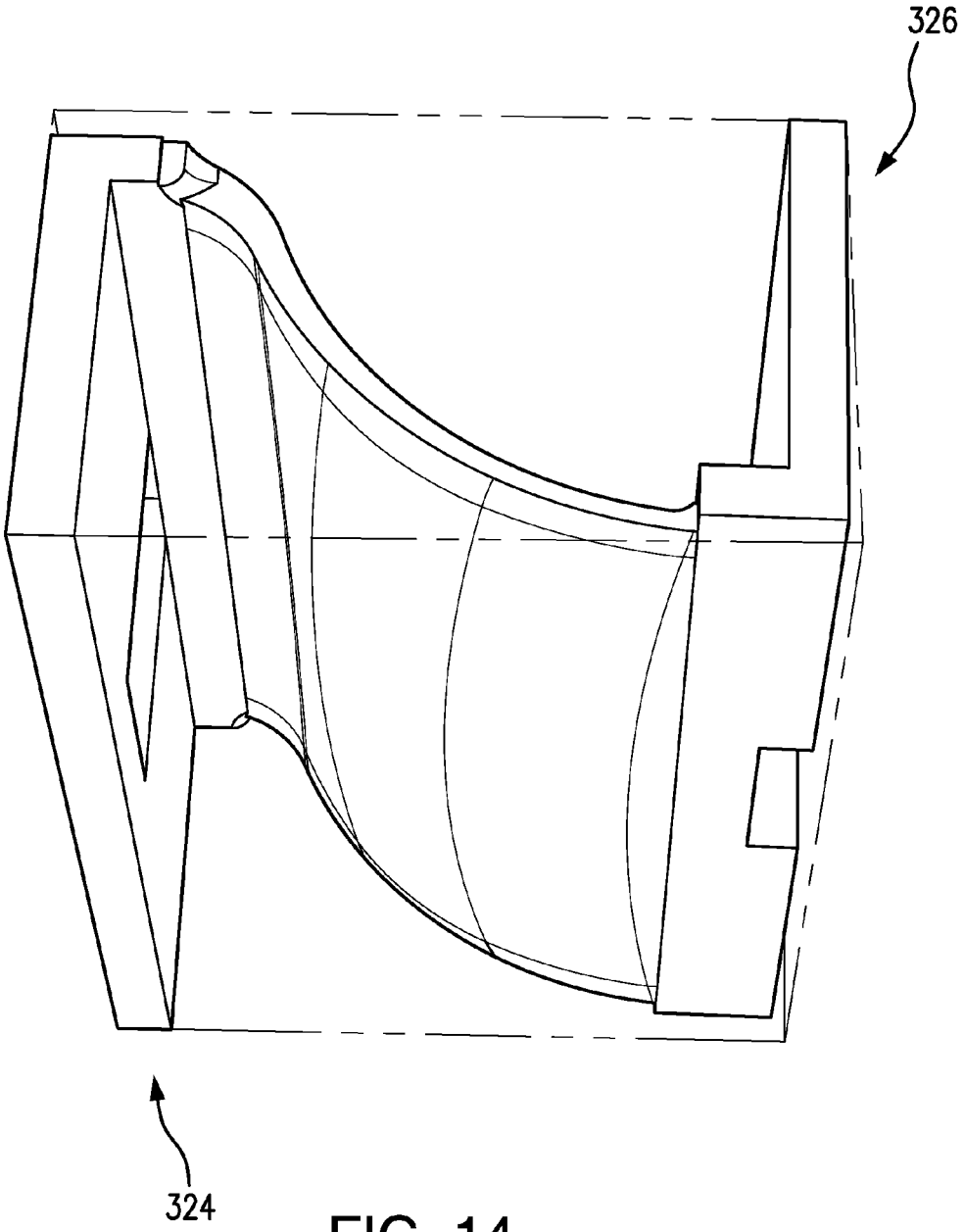
FIG. 14 is a second view of the hinge member of FIG. 13.
Figure 16:
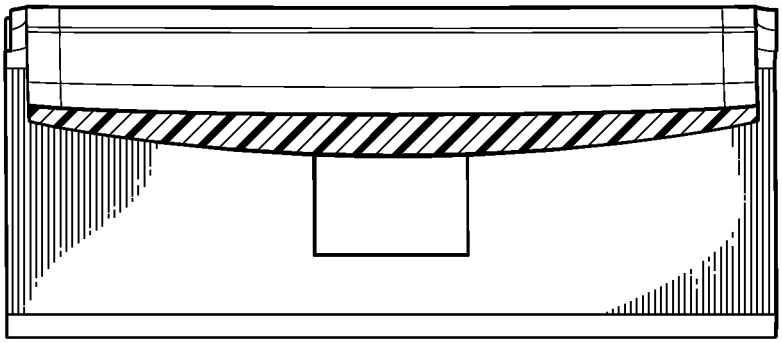
FIG. 16 is a second sectional view of the hinge of FIG. 13, taken along line 16-16.
Figure 15:
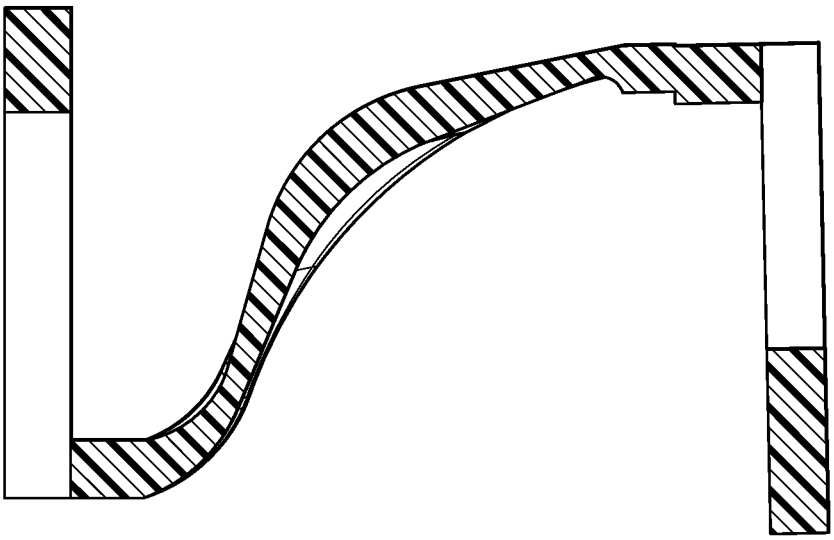
FIG. 15 is a first sectional view of the hinge of FIG. 13, taken along line 15-15.
Figure 17:
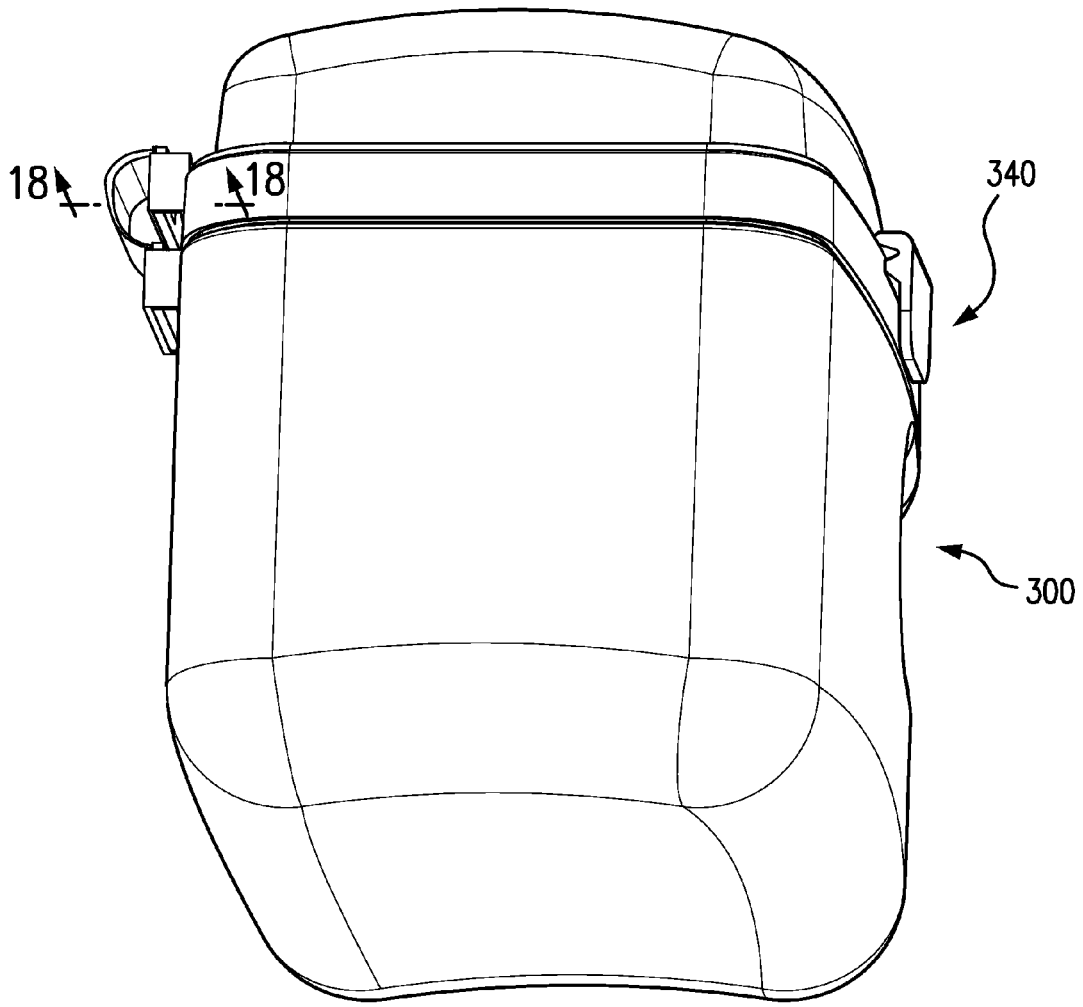
FIG. 17 is a view of the container of FIG. 12 in a closed condition (with hinges flexed).
Figure 18:
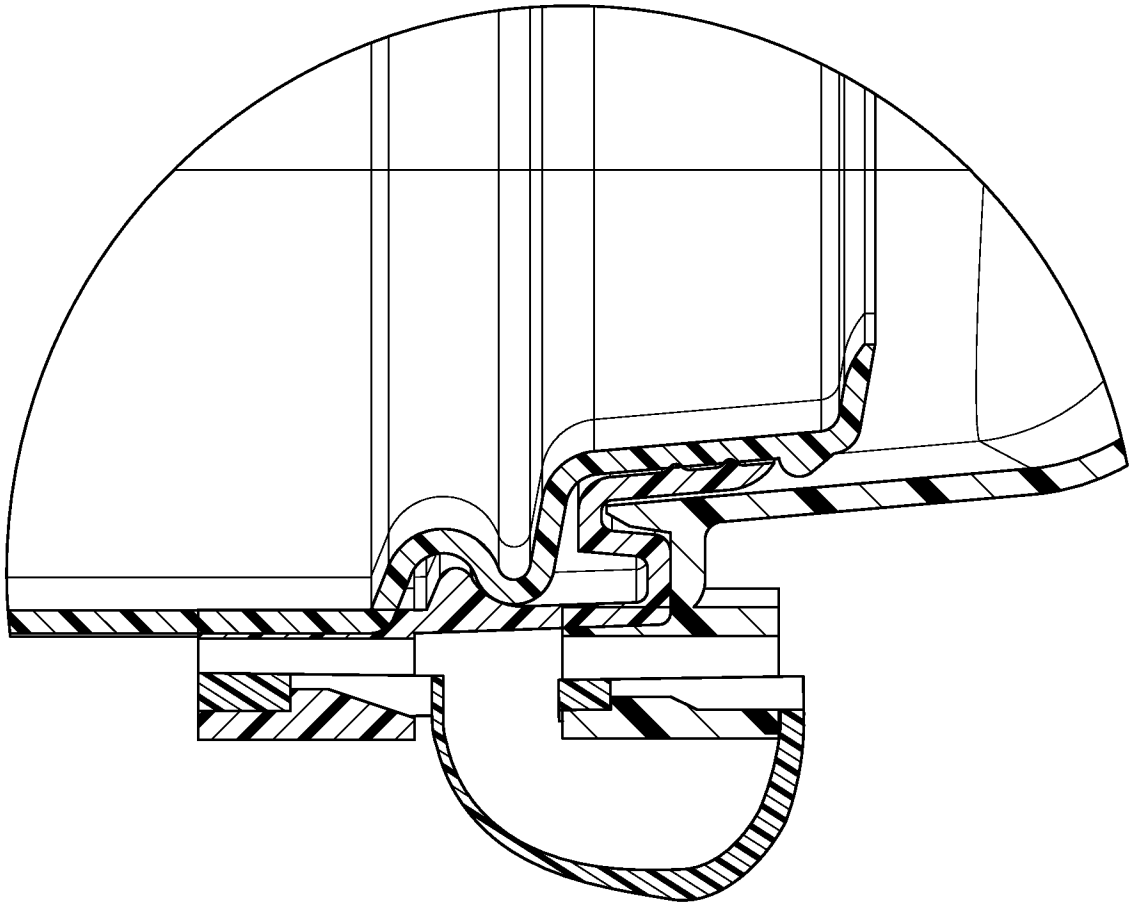
FIG. 18 is a partial sectional view of the container of FIG. 17, taken along line 18-18.

The exemplary living hinge 22 is un-slitted and extends from a first (proximal) end 80 at the base to a second (distal) end 82 at the cap. The exemplary hinge has a left edge 84 and a right edge 86. The exemplary hinge has a first (inboard) face 88 and a second (outboard) face 90 (FIG. 3). Between the proximal and distal ends, the first face has a central portion 92 (FIG. 3A) that is convex along the medial plane 520 (FIG. 4) and planes parallel thereto. The central portion is also convex transverse thereto (thus doubly convex). The adjacent central portion 94 of the second face 90 is similarly doubly concave. In the as-molded condition, a median 530 (longitudinal and transverse) of the hinge is generally upwardly convex along the central portion. The relative convexities and concavities are such that the central portion 96 is centrally relatively thick and thins away from a location 98 (FIG. 5) proximate the hinge center in both directions (lateral and proximal-distal). Curvature changes along the length of the hinge so that the exemplary face 88 is lengthwise concave and 90 lengthwise convex in a proximal region of the hinge and, along a distal region their respective convexity and concavity decreases relative to the central portion. FIG. 7 shows a central thickness $T_1$ and a thickness $T_2$ at or near the hinge edges. An exemplary thickness decrease from center to edge is of at least 30%. FIG. 7 shows a hinge width $W_1$. Exemplary $W_1$ is one inch (2.5 cm) (largely depending on container/lid size, weight, etc., but likely typically 0.5-1.5 inch (1.3-3.8 cm) or 0.75-1.25 inch (1.9-3.2 cm)).

Figure 3A:
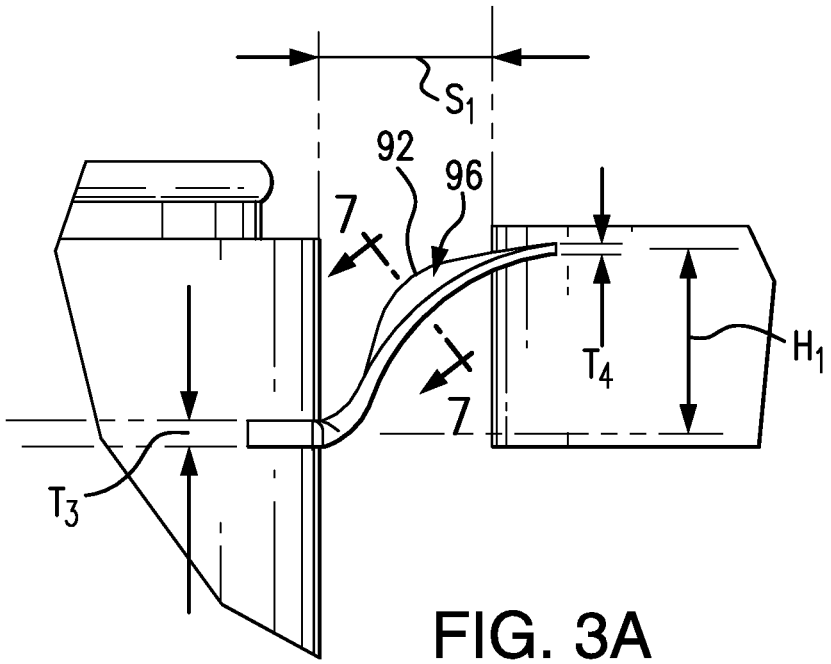
FIG. 3A is an enlarged view of the hinge of the closure of FIG. 3.

In the as-molded condition, the first end 80 and second end 82 are generally horizontal with the second end spaced upward from the first end. An exemplary vertical offset $H_1$ is at least 50% of a horizontal separation $S_1$, more narrowly close to 100% (e.g., about 80-120%). In an exemplary implementation, $T_1$ is 0.057 inch (and $T_2$ is 0.023 inch). FIG. 3A similarly shows thicknesses $T_3$ and $T_4$, respectively near the ends 80 and 82. In the exemplary embodiment, $T_3$ is 0.05 inches (1.3 mm) from edge-to-edge and $T_4$ varies from a low value (0.021 inch (0.53 mm)) at the edges to a relatively higher value (e.g., 0.035 inch (0.89 mm)) along the medial plane. Thus, in this particular embodiment, the thickness profile transversely across the hinge is relatively more uniform near the proximal end than along the central portion or along the distal end. Exemplary $T_2$ is less than 70% of $T_1$, more narrowly, less than 50% or 30-50%. Exemplary $T_1$ is 0.03-0.08 inch (0.76-2.0 mm).

Such a hinge configuration provides a snap-open action which creates a generally open relatively relaxed condition, allowing dispensing/delivery without needing the user to hold the cap open, with spring bias of the hinge maintaining the hinge in the open condition. An exemplary characterization of the transverse curvature (e.g., at the middle of the hinge in the view of FIG. 7) is the dimension $S_2$ between the surface 94 near the edge and the surface 92 near the center. The difference between this and the smaller $T_1$ may provide a proxy for the amount of effective curvature. Alternatively, a proxy (identifying the bowing associated with the curvature) may be formed by a similar offset (not marked) between the center of the cross-section at the center and the centers of the cross-section at the edges. The greater this offset, the more snap action there will be. Exemplary $S_2$ minus $T_1$ is at least 10% of $T_1$.

As the hinge articulates between the opened and closed conditions, there may be an effective over-center snap action involving a toggling of the central portion to be in a relatively stressed condition (when closed) wherein the transverse curvature is reduced or even reversed (reversal being particularly likely if relatively soft material is used). The axial curvature would also reverse. The illustration of flexed/closed conditions is an approximation reflecting artifacts of computer aided drafting.

Exemplary closure material is a molded plastic such as a conventional polypropylene or copolymerpolypropylene (CoPP) or an LDPE. In an alternative embodiment the first and second portions are mounting features respectively connecting to other components such as a separately-molded base and cap (e.g., of dissimilar plastics). FIGS. 12-18 show such an alternate container 300 having a pair of modular hinges 302. The modularity of the hinges allows the hinges to be formed separately from one or both of the container or closure body and the cap/cover/lid/etc. In this exemplary system, the hinges are separate from both. This exemplary system features a container body (e.g., a molded plastic tub) 310. A closure system (assembly) 312 includes a mounting ring (base) 314 mounted at a neck/mouth portion of the body. The closure system further includes a lid 318 and the hinges.

Each hinge includes a central living hinge portion 322 which may be generally similar to the living hinge 22. In this implementation, however, there is a slight difference in that the adjacent portions of the lid and body are straight rather than circular in planform.

Each hinge member 302 includes a first portion 324 and a second portion 326 at opposite ends of the living hinge 322. The respective first portion and second portion are formed as flat generally rectangular planform tabs for being received in accommodating pockets 330 and 332 of the ring and the lid, respectively. The exemplary tabs include apertures which receive detent barbs of the pockets to prevent/resist extraction of the tabs once inserted. When installed, the first tab 324 thus forms a proximal portion and the second tab 326 thus forms a distal portion. In the exemplary embodiment, the body, ring, lid, and hinges are all molded of plastic materials. However, the use of modular hinges allows the choice to use different hinge material from one or both mating structures (i.e., the ring or lid in the present implementation). Such differing materials may even be non-plastic. For mating with other materials, other configurations of mounting features may replace the tabs. The exemplary container includes a latch system 340 formed by cooperating features of the lid and ring.

One or more embodiments of the present invention have been described. Nevertheless, it will be understood that various modifications may be made without departing from the spirit and scope of the invention. For example, when implemented in the redesign of an existing closure, details of the closure and its use may influence details of any particular implementation. Accordingly, other embodiments are within the scope of the following claims.

What is claimed is:

1. A system (20; 302) comprising the unitarily molded single-piece combination of:

a first portion (24; 324);

a living hinge (22; 322); and a second portion (26; 326) coupled by the living hinge to the first portion and shiftable between a first condition and a second condition via rotation about the living hinge, wherein the living hinge comprises:

an upper face (88) and a lower face (90);

a first end (80) at the first portion;

a second end (82) at the second portion;

a proximal region wherein the upper face is lengthwise concave and the lower face is lengthwise convex; and a central portion (96), wherein in the as-molded condition a proximal-to-distal median of the hinge is generally upwardly convex and downwardly concave along the central portion and the upper face along the central portion is doubly convex and the lower face along the central portion is doubly concave.

2. The system of claim 1 wherein:

the first portion is a mounting base having an aperture (30);

the second portion is a cap;

the first condition is a closed condition; and the second condition is an open condition.

3. The system of claim 2 wherein:

spring bias of the living hinge will maintain the hinge in the open condition.

4. The system of claim 2 wherein:

the base is internally threaded (50);

the cap, in the closed condition, surrounds and covers an upper rim portion of the base and has a detented engagement therewith.

5. The system of claim 2 wherein:

the second condition is a relaxed condition;

the combination is molded of polypropylene.

6. The system of claim 1 wherein:

the thickness of the hinge decreases laterally from a location (98).

7. The system of claim 6 wherein:

the thickness of the hinge decreases proximally and distally from the location (98).

8. A system (20; 302) comprising the unitarily molded single-piece combination of:

a first portion (24; 324);

a living hinge (22; 322); and a second portion (26; 326) coupled by the living hinge to the first portion and shiftable between a first condition and a second condition via rotation about the living hinge, wherein the living hinge comprises:

an upper face (88) and a lower face (90);

a first end (80) at the first portion;

a second end (82) at the second portion;

a proximal region wherein the upper face is lengthwise concave and the lower face is lengthwise convex; and a central portion (96), wherein in the as-molded condition a proximal-to-distal median of the hinge is generally upwardly convex and downwardly concave along the central portion, wherein:

the location (98) is within the central portion; and in transverse cross-section at a center of the hinge, the dimension between the lower face near the edges and the upper face near the center minus a thickness $T_1$ at the center is at least 10% of that thickness.

9. The system of claim 1 wherein:

the thickness of the hinge decreases proximally and distally from a location (98).

10. A system (20; 302) comprising the unitarily molded single-piece combination of:

a first portion (24; 324);

a living hinge (22; 322); and a second portion (26; 326) coupled by the living hinge to the first portion and shiftable between a first condition and a second condition via rotation about the living hinge, wherein the living hinge comprises:

an upper face (88) and a lower face (90);

a first end (80) at the first portion;

a second end (82) at the second portion;

a proximal region wherein the upper face is lengthwise concave and the lower face is lengthwise convex; and a central portion (96), wherein in the as-molded condition a proximal-to-distal median of the hinge is generally upwardly convex and downwardly concave along the central portion, wherein:

the location is within the central portion; and in transverse cross-section near the center, centers of said transverse cross-section at edges of the hinge are downwardly offset from a center of such cross-section at the center of the hinge.

11. The system of claim 1 wherein:

in the as-molded condition, the second portion is spaced upward from the first portion by a vertical offset ($H_1$) of at least 50% of a horizontal separation ($S_1$) between the first portion and the second portion.

12. The system of claim 1 wherein:

the first portion is a first mounting feature (324); and the second portion is a second mounting feature (326).

13. The system of claim 1 wherein:

the first portion is a first mounting tab (324); and the second portion is a second mounting tab (326).

14. A container (300) comprising at least one system of claim 13 as a hinge (302) and further comprising:

a container body (310); and a closure assembly (312) comprising:

a mounting base (314) mounted to the container body;

said hinge (302) having its first mounting tab (324) received in a pocket (330) of the mounting base; and a lid having a pocket (332) receiving the second mounting tab (326).

15. A system (20; 302) comprising the unitarily molded single-piece combination of:

a first portion (24; 324);

a living hinge (22; 322); and a second portion (26; 326) coupled by the living hinge to the first portion and shiftable between a first condition and second condition via rotation about the living hinge, wherein the living hinge comprises:

a first (80) end at the first portion; and a second end (82) at the second portion, wherein, in the as-molded condition:

the second portion is spaced upward from the first portion by a vertical offset ($H_1$) of at least 50% of a horizontal separation ($S_1$) between the first portion and the second portion; and the living hinge thins away from a central portion both laterally and proximally-to-distally, with a lateral thinning being at least 30% from a center of the hinge to lateral edges of the hinge.

16. The system of claim 15 wherein:

in the as-molded condition, the first end and second end are generally horizontal.

17. The system of claim 15 wherein:

in the as-molded condition, a proximal-to-distal median of the hinge is generally upwardly convex along a central portion.

18. A method for manufacturing the system of claim 15 comprising injection molding in the as-molded condition.

19. A system (20; 302) comprising the unitarily molded single-piece combination of:

a first portion (24; 324);

a living hinge (22; 322); and a second portion (26; 326) coupled by the living hinge to the first portion and shiftable between a closed condition and an open condition via rotation about the living hinge, wherein the living hinge comprises:

an upper face (88) and a lower face (90);

a first end (80) at the first portion;

a second end (82) at the second portion;

a proximal region wherein the upper face is lengthwise concave and the lower face is lengthwise convex; and a central portion (96), wherein in the open condition a proximal-to-distal median of the hinge is generally upwardly convex and downwardly concave along the central portion and a transverse median of the hinge is generally upwardly convex and downwardly concave along the central.

20. A system (20; 302) comprising the unitarily molded single-piece combination of:

a first portion (24; 324);

a living hinge (22; 322); and a second portion (26; 326) coupled by the living hinge to the first portion and shiftable between a closed condition and an open condition via rotation about the living hinge, wherein the living hinge comprises:

a first (80) end at the first portion; and a second end (82) at the second portion, wherein, in the open condition:

the second portion is spaced upward from the first portion by a vertical offset ($H_1$) of at least 50% of a horizontal separation ($S_1$) between the first portion and the second portion; and the living hinge thins away from a central portion both laterally and proximally-to-distally.

21. The system of claim 1 wherein the living hinge further comprises a distal region and wherein a lengthwise convexity of the upper face decreases from the central portion to the distal region and a lengthwise concavity of the lower face decreases from the central portion to the distal region.

* * * * *